United States Patent [19]

Jongewaard et al.

[11] Patent Number: 4,853,365

[45] Date of Patent: Aug. 1, 1989

[54] THERMAL DYE TRANSFER-DYE RECEPTOR CONSTRUCTION

[75] Inventors: Susan K. Jongewaard; Julia A. Sills, both of St. Paul, Minn.

[73] Assignee: Minnesota Mining and Manufacturing Company, St. Paul, Minn.

[21] Appl. No.: 235,235

[22] Filed: Aug. 23, 1988

[51] Int. Cl.[4] ..... B41M 5/035; B41M 5/26

[52] U.S. Cl. ..... 503/227; 8/471; 428/195; 428/522; 428/913; 428/914

[58] Field of Search ..... 8/471; 428/195, 522, 428/913, 914; 503/227

[56] References Cited

U.S. PATENT DOCUMENTS

| | | | |
|---|---|---|---|
| 3,584,576 | 6/1971 | Kubo et al. | 101/128.2 |
| 3,736,133 | 5/1973 | Weigl et al. | 96/1.5 |
| 4,503,095 | 3/1985 | Seto et al. | 427/265 |
| 4,572,684 | 2/1986 | Sato et al. | 400/240.4 |
| 4,626,256 | 12/1986 | Kawasaki et al. | 8/471 |
| 4,651,177 | 3/1987 | Morishita et al. | 346/227 |

*Primary Examiner*—Bruce H. Hess

*Attorney, Agent, or Firm*—Donald M. Sell; Walter N. Kirn; Mark A. Litman

[57] ABSTRACT

This invention relates to a dye receptor element for thermal dye transfer which comprises a support having thereon a resinous binder consisting of chlorinated polyvinyl chloride or chlorinated polyvinyl chloride with other resinous blends. Dyes which are transferred to the dye receptor sheet have good solubility in the dye receptor sheet, and achieve high dye densities in the dye image.

21 Claims, No Drawings

THERMAL DYE TRANSFER-DYE RECEPTOR CONSTRUCTION

FIELD OF THE INVENTION

This invention is related to thermal dye transfer printing, and, in particular, to a novel dye receptor sheet for such printing using a chlorinated polyvinyl chloride resin, and blends of chlorinated polyvinyl chloride with other resins.

BACKGROUND OF THE ART

In thermal dye transfer printing, an image is formed on a receptor sheet by selectively transferring an image forming material to the receptor sheet from a dye donor sheet. Material to be transferred from the dye donor sheet is selected by a thermal printhead, which consists of small, electrically heated elements. These elements transfer image-forming material from the dye donor sheet to areas of the dye receptor sheet in an imagewise manner.

There are three broad classes of thermal transfer systems that are known, (1) chemical reaction systems, (2) thermal mass transfer systems, and (3) thermal dye transfer systems.

In chemical reaction systems, the image is formed upon the receptor as a result of the imagewise transfer of some chemical reactant from the donor sheet. An example is the transfer of a mobile molecule, such as phenol, to the receptor sheet, which bears a leuco compound thereon. The phenol is transferred by being volatilized by the heat from the thermal print head, and, upon reaching the receptor sheet, reacts with the leuco compound to convert it from the colorless to the colored form. Alternately, the phenol can be on the receptor sheet and the leuco compound can be on the donor sheet.

In thermal mass systems, no color forming chemical reaction takes place. Instead, the image is formed simply by the transfer of a mass of material containing colorant therein, such as pigment-filled polymer coatings.

In thermal dye transfer systems, a dye donor sheet is used in combination with a dye receptor sheet wherein, with the application of heat, a dye is transferred onto the receptor sheet at a controlled amount to obtain a dye image having gradation like in a photograph.

Each system has its own advantages and disadvantages for the particular application of thermal printing. Various problems have been encountered with each proposed system. For thermal dye transfer, dye release layers have been proposed to enable efficient transfer of the dye layer from the dye donor sheet. Also, various dye-permeable release layers on the dye receptor layer have been proposed. The dye-permeable release layer is coated over the dye receptor layer, and is formulated to prevent sticking between the donor layer and the receptor layer during the transfer of the dye across the binder membranes. The release layer must also be formulated to allow effective transfer of the dye through the release layer. In general, many of these problems have been related to a specific resin used in the composition of the dye donor or dye receptor layers.

Selection of the functional resin systems for the dye donor and the receptor sheet layers has been the topic of concern for many proposed dye systems. In consideration of the above mentioned requirements, efficient dye transfer and sticking between the dye donor layer and the dye receptor layer during transfer, a good, functional resin system to eliminate some of these problems is needed. Interestingly, a unique resin system has been found that provides an efficient working dye donor sheet and dye receptor sheet. The resin system comprises a chlorinated polyvinyl chloride (CPVC).

U.S. Pat. No. 3,584,576 describes a heat sensitive stencil sheet comprising a film adhered to a porous thin fibrous sheet. The stencil sheet is perforated by exposure to infrared rays. The film consists essentially of at least 75% by weight of a chlorinated polyvinyl chloride resin, the balance being a polyvinyl chloride resin. A colorant may be present in the film. Upon being heated by infrared radiation, the film melts and forms perforations. The pores in the remaining fibrous sheet enable stencilling to be done through the perforations and the sheet.

There are noticable difference between the above mentioned prior art use of CPVC in a thermally sensitive stencil applications and in the present invention. The prior art uses CPVC merely as a resinous binder, with or without other resinous binders. It is, in particular, used not as a receptor layer for a thermal dye transfer sheet, but as the thermoplastic binder for a thermal stencil sheet. The novel use of the CPVC resin in the thermal dye transfer printing of the present invention has been found to give surprisingly new and unique properties for use as the primary resinous thermal plastic binder in both a dye donor sheet, and a dye receptor sheet. Typically, commercially available dye donor sheets and dye receptor sheets are comprised of chemically different binders with different functionals.

DETAILED DESCRIPTION OF THE INVENTION

This invention relates to a thermal dye transfer image receptor sheet, and in particular to certain resin combinations used therein. More particularly, this invention relates to chlorinated polyvinyl chloride and certain chlorinated polyvinyl chloride resin blends used as the resinous binder for the thermal dye transfer receptor sheet.

Thermal transfer printing processes are well known, and commonly teach the use of a wide range of resinous binders for the makeup of the coated image receptor layer. The resinous binder layer holds the heat transferable dye to the dye receptor sheet. Several classes of resinous binders are known in the literature for use in a dye donor sheet or a dye receptor sheet. Properties often discussed in describing these resinous binders are inherent viscosity, molecular weight, glass transition temperature (Tg° C.), etc., all which contribute to the desired property as specifically compounded for the application. Desirable properties of a dye receptor sheet include:

1. The ability to intimately interface with the dye donor sheet to effectively transfer a heat transferable dye or dyes without adhesion of the two sheets.
2. The ability to receive and hold a large amount of dye to yield a high dye density image.
3. The ability to sustain the high density dye image to provide a colored print having extended shelf-life.

The transferring dye moves between the donor sheet and the image receptive surface of the dye receptor sheet. Given the intimate contact between the dye donor sheet, and the dye receptor sheet, it is understood that diffusion or sublimation of the dye will occur with the application of heat and/or pressure. When the dye is heated, the duration of the transfer of the dyes between the sheets is very short (msces.) and the dye travels a very short distance (microns).

Inherently, a dye that is quite soluble in the donor layer of the donor sheet will readily penetrate the receptor layer of the dye receptor sheet. The dye is again readily soluble in the receptor layer and therefore the dye receptor sheet will provide a dye image of high dye density which is stable for prolonged periods of time. Surprisingly, it has been found that the use of the chlorinated polyvinyl chloride resin binders, and chlorinated polyvinyl chloride blends can provide enhanced solubility for the dyes, giving a dye receptor sheet yielding high density print images.

The present invention describes a composition relating to thermal dye transfer, especially to a dye receptor sheet which will receive a dye image from a dye donor sheet, and to a transfer printing process in which the dye in the dye donor sheet is transferred from the donor sheet to a receptor sheet by the application of heat. The dye donor layer is placed in contact with a dye receptor sheet, and selectively heated in accordance with a pattern of information signals whereby the dyes are transferred to the receptor sheet. A pattern is formed thereon in a shape and density in accordance with the electrical signal and the intensity of heat applied to the donor sheet.

It is desirable to have the dye dispersed in the dye donor medium at high concentrations which at the time of transfer will yield high dye image densities. A means of measuring the efficiency of the dye transfer is by a test for transfer efficiency of the dye. Dye Transfer efficiency is related to the amount of dye available for transfer from the dye donor sheet to the dye receptor sheet, and the amount of dye recieved from the donor layer onto the receptor as a result of the transfer process. A calculated measure of the dye transfer efficiency is first done by measuring the initial reflective optical density of the coated donor sheet prior to the thermal transfer printing. The data is recorded as initial reflective optical density (IROD). Second, the reflective optical density of the transferred image on the receptor sheet is measured. The data is recorded as transferred reflective optical density (TROD). The quotient of TROD/IROD$\times$100 gives a measure of the transfer efficiency of the dye from the dye donor sheet to the dye receptor sheet.

As described above in the simple test, transfer efficiency is dependent upon the interactions of the dye donor sheet and the dye receptor sheet. Generally different resins are used in commerical thermal dye transfer constructions for this purpose. Various resin systems have been proposed which include cellulosics, vinyl butyrals, polycarbonates, polyesters, silicones, and mixtures thereof. The various resin systems discussed are each specific to a desired property. The property of providing improved dye transfer densities is desirable, and this can be accomplished through the high transfer efficiency of the dye from the dye donor sheet to the dye receptor sheet through the use of CPVC in the receptor layer.

Problems with the presently known resin systems are poor shelf-life of the dye in the donor sheet. Blooming, or movement of the dye out of the resin system, can be caused by poor solubility properties of the dye in the resin. Bleeding of the dye can occur when the dye transfers from one material onto another material, and is usually caused by some other additive which carries the dye out of the resin layer.

Accordingly, in the present invention it has been found that a chlorinated polyvinyl chloride and/or a combination of CPVC with another resin, polymer, or copolymer can substantially aid in the effective transfer of a heat transferable dye from a dye donor sheet to dye receptor sheet. This resin promotes higher dye solublility and reduces dye crystallization wherein low image print densities are obtained.

In the practice of the present invention, a dye receptor sheet is made which comprises a support having coated thereon a layer comprising a chlorinated polyvinyl chloride resin, or the CPVC resin blend coated from an organic solvent. The chlorine content of the CPVC resin binder used in the present invention is from 62%–74% by weight of the polymer. The inherent viscosity of the CPVC is generally from 0.4 to 1.5 and preferably from 0.46 to 1.15. The glass transition of the CPVC is from 100° to 160° C. The CPC should comprise at least about 25% of the total weight of binder in the receptor layer, preferably at least 40%, more preferably 50 to 100% of binder. Certain polymer plaasticizers may act as binder and plasticizer and can be used in high proportions. Low molecular weight polyesters (e.g., ICI 382 ES) seem to be useful as plasticizers in amounts up to 40–60% by weight of the solids and may increase the solubilizing effect of the CPVC.

The concentration of the CPVC in the dye receptor of the present invention is used in a concentration which will provide an effective dye receptor element. In a typical embodiment of the present invention, an amount of 25% to 100 % by weight of CPVC is used as the resinous binder in the dye receptor layer. Other resins compatible with the CPVC such as polyvinyl chloride, polyvinyl acetate, polyvinylidene chloride, cellulose derivatives (esters), styrene and/or acrylonitrile, acrylates, etc. may comprise the remainder of the polymer. These additional polymeric components may be added as blends or the units copolymerized with the vinyl chloride. Both the PVC and CPVC resins may be copolymers.

The heat transfer of the dye allows formation of a dye image having high color purity. The process is dry and takes less than 20 msecs/line to give a color image. The process may be used to achieve a multi-color image either by sequentially transferring dyes from separate donor sheets or by utilizing a donor element having two or more colors sequentially arranged on a continuous web or ribbon-like configuration, i.e. yellow, magenta, cyan, and even black.

The backing of the dye receptor can be made of any flexible, material to which an image receptive layer can be adhered. Suitable substrates in use of the present invention include substrates that are smooth or rough, transparent, opaque, and continuous or sheetlike. They may be essentially non-porous. A preferred backing is whitefilled or transparent polyethylene terephthalate or opaque paper. Representative examples of materials that are suitable for the backing substrate include polyesters, especially polyethylene terephthalate, polyethylene naphthalate, polysulphones, polystyrenes, polycarbonate, polyimide, polyamide, cellulose esters, such as cellulose acetate and cellulose butyrate, polyvinyl chlorides and derivitives, etc. The substrate may also be reflective such as in baryta-coated paper, an ivory paper, a condenser paper, or synthetic paper. The substrate generally has a thickness of 2-200 mils (0.05 to 5 mm), with greater than 0.05 mm to 1 mm preferred.

By "non-porous" in the description of the present invention it is meant that ink, paints and other liquid coloring media will now readily flow through the substrate (e.g., less than 0.05 cc/sec at 7 mm Hg pressure, preferably less than 0.02 cc/sec at 7 mm Hg pressure). The lack of significant porosity prevents absorption of the heated transfer layer into the substrate and prevents uneven heating through the backing layer. The backing sheets of U.S. Pat. No. 3,584,576 which are required to be porous in order for the stencil to work, although described as thin, are shown to be about four times greater in thickness (48 microns) than the maximum thickness of backing sheets in the present invention.

The dye image receptor layer must be compatible as a coating with most resins, since most commercially available donor sheets are resin based. Because different manufacturers generally use different resin formulations in their donor sheets, the image receptor layer should preferably have an affinity for several different resins. Because the transfer of the dye to the dye receptor sheet is essentially a contact process, it is important that there be intimate contact between the dye donor sheet and the dye receptor sheet at the instant of imaging. The softening temperature, as used herein, means Vicat softening temperature determined in accordance to ASTM D 1525 (1982) for polymers which have no sharp melting point, or, for polymers which do exhibit a sharp melting point, the melting point itself.

The proper selection of softening temperature, as described above, is a necessary condition for useful dye receptor sheet for thermal transfer printing. The softening point, however, must not allow the resin to become distorted, stretched, wrinkled, etc. In addition, in order for the receptor sheet to be useful in a commercial setting, the receptor sheet is preferably non-tacky, and is preferably capable of being fed reliably in a conventional thermal printer, and is of sufficient durability that it will remain useful after handling and feeding.

Materials that have been found useful for forming the dye receptor layer include chlorinated polyvinyl chloride in one embodiment, and blends of CPVC with other resins, in another embodiment of the present invention. The limiting factor to the resins chosen for the blend vary only to the extend of compounding for the desired property desired. Preferred copolymerizable or blendable additives include PVC, acrylonitrile, styrene-acrylonitrile copolymers, polyester, especially bisphenol A fumaric acid polyester, polymethyl methacrylate, epoxy resins, and polyvinyl pyrolidone.

When an additional resin, polymer, or copolymer is used with CPVC it is usually added in an amount of 75% by weight or less of the resinous composition of the dye receptor layer, preferably in the amount of 30% to 75% by weight. The blend of other additional resins or low melting point additives, as listed above, and modifying agents with CPVC may be present to improve the function of an effective dye receptor sheet.

Other additives and modifying agents include UV stabilizers, heat stabilizers, suitable plasticizers, surfactants, etc., used in the dye receptor of the present invention.

The dye receptor layer is usually coated out of an organic solvent. Suitable solvents are THF, MEK, and mixtures thereof, MEK/toluene blends, and THF/chlorinated solvent blends.

A dye donor element that is used with the present invention comprises a substrate with a dye donor layer coated thereon. Any heat transferable dye can be used in such a layer provided it can be transferred to a dye receptor sheet by heat. Dye may be employed singly or in combination to obtain a monochrome. The dye will preferably be present in a ratio of dye to binder of from 30:70 to 80:20.

Suitable substrates for the donor for use in the present invention include substrates that are rough or smooth, transparent or opaque, and continuous or porous. It may be of natural or synthetic polymeric resin (thermoplastic or thermoset). For the most commercial purposes the substrate is preferably a polymeric resin such as polyester (polyethylene terephthalate, which may be biaxially stablized), polyethylene napthalate, polysulfones, polycarbonate, polyimide, polyamide, or cellulose papers. The support generally has a thickness of 1-12 microns, with less than 6 microns preferred.

The dye donor layer preferably comprises, in addition to the substrate a backside coating of a heat resistant material such as a silicone or a polyurethane, higher fatty acids, fluorocarbon resin, etc., to prevent the substrate from sticking to the print head.

The dye donor element may be used in a sheet size embodiment or in a continuous roll form such as a continuous web or ribbon. If a continuous ribbon or web is used, it may have only one dye coated thereon, or may have sequentially arranged areas of different dyes, such as yellow, magenta, cyan, and/or black.

The dye layer can printed on or coated on the dye donor element by a printing technique such as by rotogravure, etc.

The dye receptor layer is prepared by introducing the various components for making the image receptive layer into suitable solvents, mixing the resulting solutions at room temprerature, then coating the resulting mixture onto the backing, and drying the remaining coating, preferably at elevated temperatures. Suitable coating techniques include knife coating, roll coating, curtain coating, spin coating, gravure, etc. The receptor layer is preferably free of any visually observable colorant (e.g., less than 0.2, preferably less than 0.1, optical density units).

As noted above, the dye donor sheet and the dye receptor sheet are used to form a dye transfer image. The process involves image-wise heating a dye donor sheet and transferring a dye image to a dye receptor sheet to obtain a dye transfer image.

The quality of the resulting dye image can be improved by readily adjusting the size of the heat source which is used to supply the heat energy, the contact place of the dye donor sheet and the dye receptor sheet, and the heat energy. Heat sources can include laser light, infrared flash, heated pens, etc. The applied heat energy is controlled to give light and dark gradation of the image and also for the efficient diffusion or sublimation of the dye from the dye donor sheet to ensure the continuous gradation of the image as in a photograph.

By using in combination with a dye donor sheet, the dye receptor sheet of the present invention can be utilized in the print preparation of a photograph by printing, facsimile, or magnetic recording systems wherein various printers of thermal printing systems are used, or print preparation for a television picture, or CRT picture by operation of a computer, or a graphic pattern or fixed image for suitable means such as a video camera, and also in the production of progressive patterns from an original by an electronic scanner which is used in photomechanical processes of printing.

The invention is further illustrated by the following examples in which all parts are by weight unless otherwise indicated.

Table of dyes to be used in the dye donor sheet of the present invention (dye receptor construction).

| | |
|---|---|
| Dye 1 | Color in Color cyan (2-chloro-2'-methyl-n-n-diethylindoaniline) |
| Dye 2 | Diethyl Magenta (4-tricyanovinyl-N,N—diethylaniline) |

Table of resins to be used in the dye donor and dye receptor constructions of the present invention (dye receptor construction).

| Commercial Name | CPVC | Chlorine Content |
|---|---|---|
| Temprite ® 678x512 | X | 62.5 |
| Temprite ® 663x612 | X | 70.0 |
| Temprite ® T-1509 | X | 67.0 |

Table of additives used in the dye donor or dye receptor constructions of the present invention (dye receptor).

| Additive | Composition | Source |
|---|---|---|
| EPON ® 1002 | Epoxy Resin | Shell Chem. Co. |
| VITEL ® PE 200 | Vitel Polyester | Goodyear |
| FERRO ® 1237 | Heat Stabilizer | BASF |
| PLASTOLEIN ® 9776 | Polyester | Emery |
| UVINUL ® N539 | UV Stabilizer | BASF |
| RD 1203 | 60/40 blend of octadecyl acrylate/ acrylic acid | 3M |
| FLUORAD ® FC 431 | Fluorocarbon (surfactant) | 3M |
| PMMA | Polymethyl methacrylate (low molecular weight) | Aldrich |
| EHEC | Ethyl hydroxy ethyl cellulose | Hercules |
| PKHH | Bisphenol A polymer | Union Carbide |
| TYRIL ® 880B | Styrene-acrylonitrile copolymer | Dow Chem. |
| ICI 382ES | Bisphenol A fumaric acid polyester | ICI Americas, Inc |
| TINUVIN ® 328 | UV stabilizer | Ciba-Geigy |
| DOBP | UV stabilizer 4-dodecyloxy-2-hydroxybenzo-phenone | Eastman Kodak Chemicals |

Dye receptor constructions of the present invention

Dye receptor constructions were made of adding in order the following components for each example as listed below.

| Component | Amount (grams) |
|---|---|
| Epon ® 1002 | 0.040 |
| Vitel ® PE 200 | 0.040 |
| Fluorad ® FC 431 | 0.050 |
| Tinuvin ® 328 | 0.015 |
| Uvinul ® N539 | 0.040 |
| Ferro ® 1237 | 0.050 |
| DOBP (stabilizer-Kodak) | 0.080 |
| THF | 4.560 |
| MEK | 1.850 |

The solution was mixed, and for each example made, the following resins added to make-up individual dye receptor examples. Examples 1–2 consisted of only CPVC resin. Examples 3–12 consisted of CPVC blends.

| Example No. | | Amount (grams) |
|---|---|---|
| 1 | Temprite ® CPVC 678x512 | 0.050 |
| | THF | 0.950 |
| 2 | Temprite ® CPVC T-1509 | 0.050 |
| | THF | 0.950 |
| 3 | CPVC 678x512 | 0.200 |
| | ICI 382ES | 0.250 |
| 4 | CPVC 678x512 | 0.100 |
| | CPVC 663x612 | 0.100 |
| | ICI 382ES | 0.250 |
| 5 | CPVC 678x512 | 0.100 |
| | PVC 178 | 0.100 |
| | ICI 382ES | 0.250 |
| 6 | CPVC 678x512 | 0.200 |
| | CAB 272-20 | 0.600 |
| 7 | CPVC 678x512 | 0.200 |
| | TYRIL ® 880B | 0.060 |
| 8 | CPVC 678x512 | 0.200 |
| | PMMA | 0.060 |
| 9 | CPVC 678x512 | 0.200 |
| | PE 200 | |
| 10 | CPVC 678x512 | 0.200 |
| | PMMA/PVP (5:1) | 0.060 |
| 11 | CPVC 678x512 | 0.200 |
| | EHEC 0.060 | |
| 12 | CPVC 678x512 | 0.200 |
| | PKHH | 0.060 |

Solutions were coated onto a 4 mil (0.109 mm) polyethylene terephthalate substrate using a #8 wire wound Meyer bar (0.72 mils [.02 mm]wet thickness) and hot air dried.

Dye donor sheets were prepared by adding the components in the following order as listed below. Solutions were coated onto 6 micron Teijin F24G thermal transfer Film (available from Teijin of Japan) using a #8 wire wound Meyer bar and then air dried.

| | Amount |
|---|---|

-continued

| Donor construction No. 1 | (grams) |
|---|---|
| CPVC 678x512 | 0.040 |
| RD 1203 | 0.010 |
| Dye 1 | 0.060 |
| THF | 2.410 |
| MEK | 0.410 |

| Donor construction No. 2 | Amount (grams) |
|---|---|
| CPVC 678x512 | 0.040 |
| Dye 2 | 0.030 |
| 1-amino-4-hydroxy-anthraquinone | 0.030 |
| Uvinul ® N539 | 0.015 |
| THF | 2.410 |
| MEK | 0.410 |

Dye donor and dye receptor sheets were assembled and imaged with a Kyocera KMT thermal print head with a burn time of 4–7 msecs.at 13.5 volts, and a burn profile of 70/40 (70 milliseconds on/40 milliseconds off). The finished size of the sheets varied. The typical size of the sheets used was 2–5 inches in length matched to the dye donor sheet size used. Levels of gradation were recorded, as well as IROD, TROD, and transfer efficiencies.

Compiled data from donor and receptor sheet evaluations.

| Receptor Example No. | Donor No. | TROD | IROD | Transfer Efficiencies | Grey Levels |
|---|---|---|---|---|---|
| 1 | 1 | 1.90 | 2.20 | 86 | Yes |
| | 2 | 1.93 | 2.17 | 89 | Yes |
| 2 | 1 | 1.66 | 2.15 | 77 | Yes |
| | 2 | 1.88 | 2.16 | 87 | Yes |
| 3 | 1 | 2.23 | 2.42 | 92 | Yes |
| | 2 | 1.91 | 1.97 | 97 | Yes |
| 4 | 1 | 1.78 | 2.18 | 82 | Yes |
| | 2 | 1.95 | 2.17 | 90 | Yes |
| 5 | 1 | 2.12 | 2.27 | 93 | Yes |
| | 2 | 1.93 | 2.15 | 90 | Yes |
| 6 | 1 | 1.73 | 2.26 | 77 | Yes |
| | 2 | 2.00 | 2.16 | 93 | Yes |
| 7 | 1 | 1.74 | 2.10 | 83 | Yes |
| | 2 | 1.93 | 2.19 | 88 | Yes |
| 8 | 1 | 1.93 | 2.20 | 88 | Yes |
| | 2 | 1.92 | 2.10 | 91 | Yes |
| 9 | 1 | 1.99 | 2.29 | 87 | Yes |
| | 2 | 1.88 | 2.10 | 90 | Yes |
| 10 | 1 | 2.16 | 2.31 | 94 | Yes |
| | 2 | 1.85 | 2.06 | 90 | Yes |
| 11 | 1 | 2.11 | 2.30 | 92 | Yes |
| | 2 | 1.84 | 2.13 | 86 | Yes |
| 12 | 1 | 1.78 | 2.29 | 78 | Yes |
| | 2 | 1.57 | 2.17 | 72 | Yes |

Competitive receptor analysis

Samples of commercially available dye receptor sheets were used in a test with the dye receptor sheets of the present invention. Tests were run using samples from a Hitachi thermal dye transfer system-Hitachi VY-100, and a Kodak thermal dye transfer system-Kodak SV-100 Color Video. Dye donor samples from each of the systems were tested using each systems respective dye receptor sheet and the dye receptor sheet of Example 1 of the present invention.

Donor and receptor sheets were assembled and imaged with a Kyocera KMT thermal printer with a burn time of 4–7 msces. at 13.5 volts, and a burn profile of 70/40. Data obtained is listed below.

| | Hitachi Dye Receptor | | Dye Receptor No. 1 | |
|---|---|---|---|---|
| Hitachi System | ROD | Transfer Efficiency | ROD | Transfer Efficiency |
| Yellow | .48 | 50 | .55 | 57 |
| Magenta | .70 | 31 | .80 | 36 |
| Cyan | .70 | 26 | .96 | 36 |

| | Kodak Dye Receptor | | Dye Receptor No. 1 | |
|---|---|---|---|---|
| Kodak System | ROD | Transfer Efficiency | ROD | Transfer Efficiency |
| Yellow | .80 | 44 | 1.04 | 58 |
| Magenta | .86 | 42 | 1.08 | 53 |
| Cyan | .66 | 30 | 0.82 | 38 |

It is well known in the art to add protective layers or other auxiliary layers over the receptor layer of the receptor element or over the donor layer of the donor element.

As noted above, commercially available CPVC has from about 62 to 74% by weight chlorine in the polymer chain. PVC itself has about 56% chlorine by weight. It is therefore possible to partially chlorinate PVC so that its chlorine content could be above 56% and below 62% by weight. The only reason that this is not as desirable is the inconvenience in obtaining chlorination levels which are not commercially available. There is no functional necessity in the selection of the CPVC that requires greater than 62% although the glass transition temperature does tend to increase with increasing levels of chlorination.

What is claimed is:

1. A thermal dye transfer receptor element for thermal dye transfer in intimate contact with a dye transfer donor sheet, said receptor element comprising a substrate having coated thereon a dye-receiving layer, characterized in that said dye receiving layer comprises a chlorinated polyvinyl chloride resin wherein the chlorinated polyvinyl chloride has a chlorine content of between 62–74%, a glass transition of between 100°–1610° C., and an inherent viscosity of 0.46-1.15, said donor sheet comprising a substrate with a dye donor layer coated thereon, and said dye-receiving layer being in intimate contact with said dye donor layer.

2. The element of claim 1 characterized in that said chlorinated polyvinyl chloride is present from 25–100% by weight of the binder in the dye receptor layer.

3. The element of claim 2 wherein said layer is free of visually observable colorant.

4. The element of claim 2 wherein said substrate is transparent.

5. The element of claim 1 characterized in that the chlorinated polyvinyl chloride resin blend is present from 50–10% by weight of the binder in the dye receptor layer.

6. The element of claim 5 wherein said layer is free of visually observable colorant.

7. The element of claim 1 wherein said layer is free of visually obserable colorant.

8. The element of claim 7 wherein said substrate is transparent.

9. The element of claim 1 wherein said substrate is transparent.

10. A thermal dye transfer receptor element for thermal dye transfer in intimate contact with a dye donor sheet, said receptor element comprising a substrate of 0.05 to 5 mm having coated thereon a dye-receiving layer, characterized in that said dye receiving layer comprises a chlorinated polyvinyl chloride resin or a chlorinated polyvinyl chloride resin blend wherein the chlorinated polyvinyl chloride has a chlorine content of between 62–74% said donor sheet comprising substrate with a dye donor layer coated thereon, and said dye-receiving layer being in intimate contact with said dye donor layer.

11. The element of claim 10 characterized in that said chlorinated polyvinyl chloride resin is present from 25–100% by weight of the binder in the dye receptor layer.

12. The element of claim 11 wherein said layer is free of visually observable colorant.

13. The element of claim 10 characterized in that the chlorinated polyvinyl chloride resin blend is present from 50–10% by weight of the binder in the dye receptor layer.

14. The element of claim 13 wherein said layer is free of visually observable colorant.

15. The element of claim 10 wherein said layer is free of visually observable colorant.

16. The element of claim 15 wherein said substrate is transparent.

17. The element of claim 10 wherein said substrate is transparent.

18. A thermal dye transfer receptor element for thermal dye transfer in intimate contact with a dye donor sheet, said receptor element comprising a non-porous substrate of 0.05 to 5 mm having coated thereon a dye-receiving layer, characterized in that said dye receiving layer comprises a chlorinated polyvinyl chloride resin or a chlorinated polyvinyl chloride resin blend wherein the chorinated polyvinyl chloride resin has a chloride content of between 62–74% said donor sheet comprising substrate with a dye donor layer coated thereon, and said dye-receiving layer being in intimate contact with said dye donor layer.

19. The element of claim 18 characterized in that said chlorinated polyvinyl chloride is present from 25–100% by weight of the binder in the receptor layer.

20. The element of claim 18 wherein said layer is free of visually observable colorant.

21. A process of transferring dye onto a thermal dye transfer receptor element for thermal dye transfer comprising a substrate having coated thereon a dye-receiving layer, characterized in that said dye receiving layer comprises a chlorinated polyvinyl chloride resin wherein the chlorinated polyvinyl chloride has a chlorine content of between 62–74%, a glass transition of between 100°–160° C., and an inherent viscosity of 0.46-1.15, said process comprising (1) contacting said element with a donor sheet having a dye donor layer comprising dye in a polyvinyl chloride resin, chlorinated polyvinyl chloride, or mixture thereof, (2) heating the backside of said donor sheet, and (3) transferring dye to said receptor element.

* * * * *